US008199947B2

(12) United States Patent
Rass

(10) Patent No.: US 8,199,947 B2
(45) Date of Patent: Jun. 12, 2012

(54) BINAURAL HEARING SYSTEM WITH MAGNETIC CONTROL

(75) Inventor: Uwe Rass, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1250 days.

(21) Appl. No.: 11/789,230

(22) Filed: Apr. 24, 2007

(65) Prior Publication Data

US 2007/0253584 A1 Nov. 1, 2007

(30) Foreign Application Priority Data

Apr. 27, 2006 (DE) ..... 10 2006 019 693

(51) Int. Cl.
*H04R 25/00* (2006.01)

(52) U.S. Cl. ..... 381/315; 381/23.1; 381/312; 381/329

(58) Field of Classification Search ..... 381/23.1, 381/312–331
See application file for complete search history.

(56) References Cited

U.S. PATENT DOCUMENTS

| | | | | |
|---|---|---|---|---|
| 4,955,729 | A | 9/1990 | Marx | |
| 6,472,986 | B1 * | 10/2002 | Sorriaux | 340/571 |
| 7,016,511 | B1 * | 3/2006 | Shennib | 381/315 |
| 2004/0052392 | A1 | 3/2004 | Sacha et al. | |
| 2005/0259838 | A1 | 11/2005 | Barthel et al. | |

FOREIGN PATENT DOCUMENTS

| | | | |
|---|---|---|---|
| DE | 7011139 | U | 3/1970 |
| DE | 3109049 | A1 | 9/1982 |
| DE | 69527534 | T2 | 6/1997 |
| DE | 298 19 993 | U1 | 2/1999 |
| DE | 102004025123 | A1 | 7/2005 |
| DE | 102004010198 | A1 * | 9/2005 |
| EP | 0674466 | A1 | 3/1995 |
| EP | 0941014 | B1 | 9/1999 |
| WO | 02074011 | A2 | 9/2002 |

OTHER PUBLICATIONS

Communication from German Patent Office, received Aug. 23, 2011, pp. 1-7.

* cited by examiner

*Primary Examiner* — Davetta W Goins
*Assistant Examiner* — Matthew Eason

(57) ABSTRACT

The invention is aimed at enabling a hearing system, particularly a binaural hearing aid system, to be controlled in an easy manner, taking into account the small amount of installation space available. A hearing system is provided comprising a first hearing device and a second hearing device. The first hearing device has a permanent magnet. The second hearing device has a magnetic field sensor such that the second hearing device is controlled in a predetermined manner when the first hearing device is located in close physical proximity to the second hearing device and consequently the magnetic field sensor detects the magnetic field of the permanent magnet or a corresponding magnetic flux. The sensor signal is used in particular for switching off the second hearing device. The first hearing device preferably possesses a mirrored structure so that it is controlled or switched when it is brought closer to the second hearing device.

19 Claims, 1 Drawing Sheet

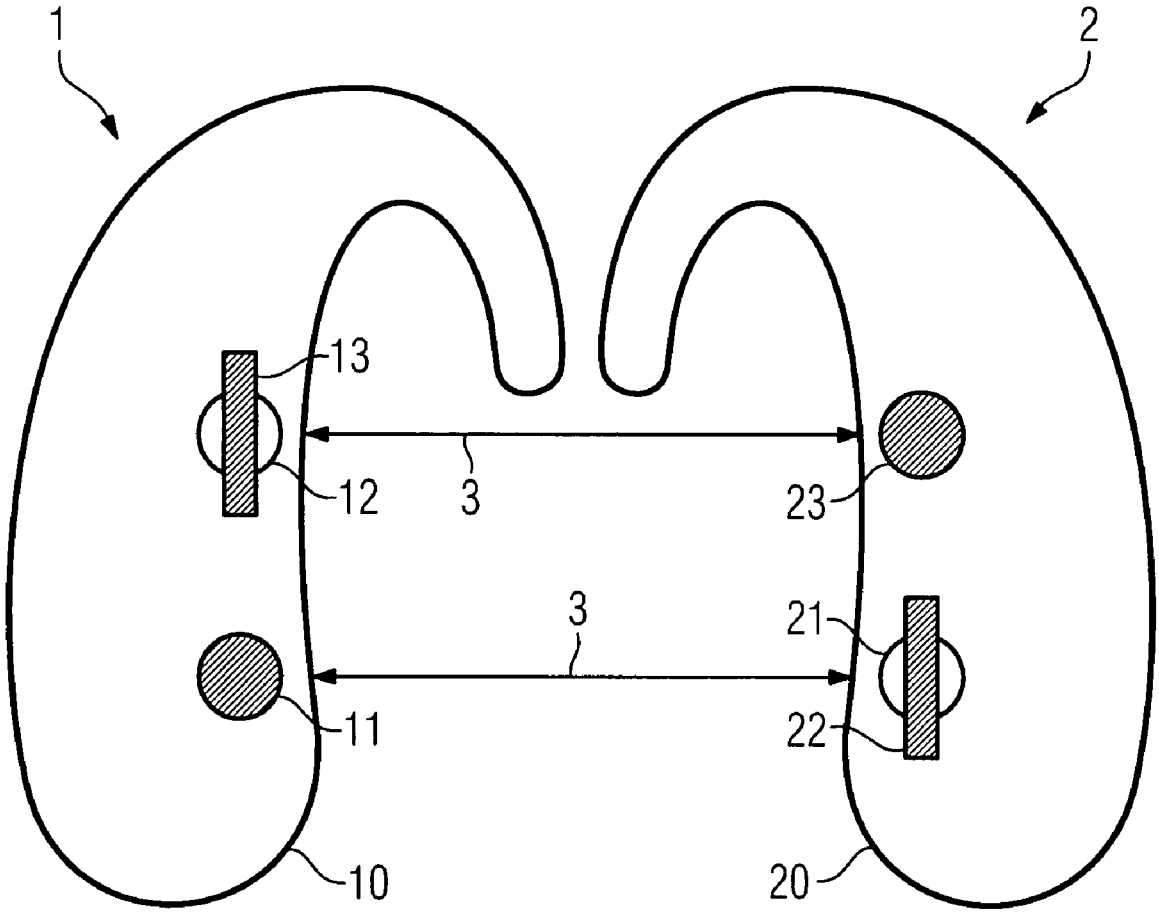
1
2
13
12
3
23
3
21
11
22
10
20

BINAURAL HEARING SYSTEM WITH MAGNETIC CONTROL

CROSS REFERENCE TO RELATED APPLICATIONS

This application claims priority of German application No. 10 2006 019 693.7 filed Apr. 27, 2006, which is incorporated by reference herein in its entirety.

FIELD OF THE INVENTION

The present invention relates to a hearing system comprising a first hearing device for wearing in/on the ear and a second hearing device also for wearing in/on the ear. The present invention relates more particularly to a binaural hearing aid system. However, the invention can also be applied to other hearing devices such as headsets, headphones and the like.

BACKGROUND OF THE INVENTION

A battery compartment switch is frequently used for switching hearing aids on and off. The battery compartment can be opened as far as a stop position, thereby interrupting the electric circuit. Battery compartments of this kind are relatively fault-prone and take up a lot of space in the hearing aid casing. Furthermore it is very difficult to achieve a waterproof connection.

As well as these battery compartment switches, standard switches and pushbutton switches are, of course, also used for switching hearing aids on and off. However, these standard switching devices have the disadvantage of requiring a lot of space in the hearing aid casing.

The publication DE 7011139U describes a hearing aid having a reed relay switch enclosed within the hearing aid casing. Said reed relay switch can be rendered open circuit by a magnet disposed outside the casing. The hearing aid can, for example, be stored in a receptacle when it is not being used. The receptacle contains a coil or a permanent magnet by means of which the reed relay switch is opened when the hearing aid is placed in the receptacle. What is disadvantageous about this arrangement, however, is that the receptacle must be to hand in order to switch off the hearing aid if no other switch is provided.

SUMMARY OF THE INVENTION

The object of the present invention is to propose a hearing system which can be easily controlled, with as little installation space as possible being used for the control components.

This object is achieved according to the invention by a hearing system comprising a first hearing device for wearing in/on the ear and a second hearing device for wearing in/on the ear, the first hearing device having a permanent magnet and the second hearing device having a magnetic sensor, such that the second hearing device can be controlled in a predetermined manner when the first hearing device is located in close physical proximity to the second hearing device and consequently the magnetic sensor detects the magnetic field of the permanent magnet or a corresponding magnetic flux.

Also provided according to the present invention is a method for controlling a hearing system which has a first and a second hearing device, by placing the first hearing device, which comprises a permanent magnet, in close physical proximity to the second hearing device, which includes a magnetic sensor, detecting a magnetic field of the permanent magnet or a magnetic flux caused by the permanent magnet, and controlling the second hearing device as a function of the detection result.

One or both hearing devices of the hearing system according to the invention can therefore be controlled without the user having to operate a mechanical switch. Furthermore, the hearing devices can be implemented in a waterproof design since the point of weakness represented by the switch or, as the case may be, battery compartment is omitted. In addition the user of the hearing system can readily recognize that the hearing device(s) is/are in a particular control mode when they are placed close together.

The second hearing device preferably includes a ferromagnetic element for interacting with the permanent magnet of the first hearing device. In this way the two hearing devices mutually attract each other and remain in the predetermined control or, as the case may be, switching state.

The magnetic flux in the ferromagnetic element of the second hearing device can be detected by means of the magnetic sensor of the second hearing device. An arrangement of this kind proves to be favorable since the ferromagnetic element bundles the magnetic field lines of the permanent magnet of the first hearing device.

The second hearing device can also have a permanent magnet and the first hearing device a magnetic sensor, such that the first hearing device can be controlled as a function of the presence of the second hearing device. As a result the two hearing devices are of symmetrical design and mutual control is possible. With this design the first hearing device can likewise include a ferromagnetic element for interacting with the permanent magnet of the second hearing device. In addition the magnetic sensor of the first hearing device, like that of the second hearing device, can be embodied in such a way that it detects the magnetic flux in the ferromagnetic element of the first hearing device.

In a particularly preferred embodiment the two hearing devices have an external structure based on the slot-and-key principle and so can be plugged into each other. By this means they are mechanically connected to each other for the purpose of mutual control.

The magnetic sensor favorably includes a Hall-effect probe, a probe according to the GMR (Giant Magneto Resistance) principle or a reed contact. In this way robust and inexpensive magnetic sensors can be implemented.

The two hearing devices are preferably embodied as hearing aids. In this case the benefit of the invention is shown to particular advantage since the small hearing aids usually have little room for installing switches and no further device or arrangement, in particular no receptacle, is necessary for controlling the hearing aids.

The two hearing devices can communicate with each other by means of a wireless connection, with the result that the first hearing device can also be controlled by means of a signal of the magnetic sensor of the second hearing device. This is particularly advantageous when communication facilities allowing a wireless connection are already provided in both hearing aids in any case, in a binaural hearing aid system for example.

The second hearing device can be switched off when the permanent magnet of the first hearing device is detected. Conversely, the first hearing device can also be switched off when the permanent magnet of the second hearing device is detected. This special control case proves advantageous in particular with regard to energy saving.

BRIEF DESCRIPTION OF THE DRAWINGS

The present invention will now be explained in more detail with reference to the attached drawing, which shows a binaural hearing aid system according to the invention.

DETAILED DESCRIPTION OF THE INVENTION

The exemplary embodiments described in greater detail below represent preferred embodiments of the present invention.

The hearing aid system illustrated in the FIGURE consists of a first hearing aid 1 and a second hearing aid 2. A permanent magnet 11 is contained in the shell 10 of the first hearing aid 1. A ferromagnetic metal piece 21 and a magnetic field sensor 22 are disposed in the hearing aid shell 20 of the second hearing aid 2. Conversely, a permanent magnet 23 is also contained in the second hearing aid 2 or, as the case may be, in its shell 20, and an associated ferromagnetic metal piece 12 and a magnetic field sensor 13 are disposed in the shell 10 of the first hearing aid 1.

When the hearing aids 1, 2 are not being worn, the user brings the hearing aid casings 10, 20 together so that they are held together by magnetic force 3, possibly supported by geometric structures ("slot and key"). The respective magnetic field sensor 13, 22 detects the field of the corresponding permanent magnet 11, 23 and thereupon switches off the associated hearing aid 1, 2. If the two hearing aids are equipped as mirror images, as in the present example, both hearing aids 1, 2 are switched off when brought closer together.

The signal of the magnetic field sensors 13, 22 can also be used to control the electronics of the respective hearing aid 1, 2. For example, the hearing aid can be switched to a so-called "sleep mode" when the other hearing aid is close by, with the result that the energy consumption of the hearing aid is reduced accordingly. Moreover it may also be worthwhile simply to reduce the volume or, as the case may be, amplification of the hearing aid when the other hearing aid is close by, which proximity indicates that the hearing aids are not in use. The signal of the magnetic field sensor can also be used to switch off a communication interface for a wireless connection.

The magnetic field sensors 13, 22 can be implemented as Hall-effect probes, in which case the hearing aid chip is switched off electrically. Alternatively a mechanical reed contact which opens the electric circuit when a magnetic field is present can also be used. In the latter case the electric circuit is opened mechanically.

If both hearing aids 1, 2 have a wireless communication link, it is sufficient if a permanent magnet/magnetic field sensor pair is accommodated in the two hearing aids. In this case a corresponding sensor signal will then be generated when the two hearing aids are brought close to each other and used for controlling the hearing aid with the sensor. By means of the communication link the sensor signal is also transmitted to the other hearing aid, with the result that it can be utilized there too.

According to the invention it is thus possible to implement an on/off switch which requires no control elements or apertures of any kind in the casing. This means that the hearing aid can be better protected against water. A further advantage is that the hearing aid system is switched on and off automatically and intuitively.

The invention claimed is:

1. A hearing system, comprising a first hearing device comprising a permanent magnet; and a second hearing device comprising a magnetic sensor that detects a magnetic field of the permanent magnet so that the second hearing device is controlled based on the detection, wherein the second hearing device comprises a ferromagnetic element that bundles magnetic field lines of the permanent magnet of the first hearing device, and wherein the magnetic sensor of the second hearing device detects the magnetic field of the permanent magnet of the first hearing device by detecting bundled magnetic field lines produced by the ferromagnetic element of the second hearing device.

2. The hearing system as claimed in claim 1, wherein the magnetic sensor detects the magnetic field of the permanent magnet when the first hearing device is located close to the second hearing device.

3. The hearing system as claimed in claim 1, wherein the second hearing device is switched off or to a sleep mode when the magnetic field of the permanent magnet is detected.

4. The hearing system as claimed in claim 1, wherein a volume or an amplification of the second hearing device is reduced when the magnetic field of the permanent magnet is detected.

5. The hearing system as claimed in claim 1, wherein the magnetic sensor detects a magnetic flux of the magnetic field when the first hearing device is located close to the second hearing device.

6. The hearing system as claimed in claim 1, wherein the second hearing device comprises a further permanent magnet, and wherein the first hearing device comprises a further magnetic sensor that detects a further magnetic field of the further permanent magnet so that the first hearing device is controlled based on the detection.

7. The hearing system as claimed in claim 6, wherein the first hearing device is switched off or to a sleep mode when the further magnetic field of the further permanent magnet is detected.

8. The hearing system as claimed in claim 6, wherein a volume or an amplification of the first hearing device is reduced when the further magnetic field of the further permanent magnet is detected.

9. The hearing system as claimed in claim 6, wherein the first hearing device comprises a further ferromagnetic element that bundles magnetic field lines of the further permanent magnet of the second hearing device, and wherein the magnetic sensor of the first hearing device detects the magnetic field of the permanent magnet of the second hearing device by detecting bundled magnetic field lines produced by the further ferromagnetic element of the first hearing device.

10. The hearing system as claimed in claim 1, wherein the magnetic sensor is a Hall-effect probe.

11. The hearing system as claimed in claim 1, wherein the first and second hearing devices are plugged into an external structure, and wherein the external structure is a slot-and-key structure.

12. The hearing system as claimed in claim 1, wherein the first and second hearing devices communicate with each other via a wireless connection, wherein a signal of the magnetic sensor of the second hearing device is transmitted to the first hearing device via the wireless connection, and wherein the first hearing device is controlled by the transmitted signal.

13. The hearing system as claimed in claim 1, wherein the first and second hearing devices are hearing aids.

14. A method for controlling a hearing system comprising a first and a second hearing device, comprising:

arranging a permanent magnet in the first hearing device;

arranging a magnetic sensor in the second hearing device;

arranging a ferromagnetic element in the second hearing device that bundles magnetic field lines of the permanent magnet of the first hearing device, using the magnetic sensor of the second hearing device for detecting a magnetic field of the permanent magnet by detecting the bundled magnetic field lines produced by the ferromagnetic element of the second hearing device; and controlling the second hearing device as a function of the detection.

15. The method as claimed in claim 14, wherein the magnetic sensor detects the magnetic field of the permanent magnet when the first hearing device is located close to the second hearing device.

16. The method as claimed in claim 14, wherein the second hearing device is switched off or to a sleep mode when the magnetic field of the permanent magnet is detected.

17. The method as claimed in claim 14, wherein a volume or an amplification of the second hearing device is reduced when the magnetic field of the permanent magnet is detected.

18. The method as claimed in claim 14, wherein the first and second hearing devices communicate with each other via a wireless connection, wherein a signal of the magnetic sensor of the second hearing device is transmitted to the first hearing device via the wireless connection, and wherein the first hearing device is controlled by the transmitted signal.

19. The method as claimed in claim 14, wherein the second hearing device comprises a further permanent magnet, and wherein the first hearing device comprises a further magnetic sensor for detecting a farther magnetic field of the further permanent magnet so that the first hearing device is controlled based on the detection.

* * * * *